US009517420B2

(12) United States Patent
White et al.

(10) Patent No.: US 9,517,420 B2
(45) Date of Patent: Dec. 13, 2016

(54) WATER AMUSEMENT DEVICE

(76) Inventors: Jill White, Kelowna (CA); James Irvine, Kelowna (CA)

( * ) Notice: Subject to any disclaimer, the term of this patent is extended or adjusted under 35 U.S.C. 154(b) by 0 days.

(21) Appl. No.: 13/502,111

(22) PCT Filed: Oct. 12, 2010

(86) PCT No.: PCT/CA2010/001582

§ 371 (c)(1),
(2), (4) Date: Apr. 13, 2012

(87) PCT Pub. No.: WO2011/044675

PCT Pub. Date: Apr. 21, 2011

(65) Prior Publication Data

US 2012/0202608 A1 Aug. 9, 2012

Related U.S. Application Data

(60) Provisional application No. 61/272,611, filed on Oct. 13, 2009.

(51) Int. Cl.
*A63G 31/00* (2006.01)

(52) U.S. Cl.
CPC ..... *A63G 31/007* (2013.01)

(58) Field of Classification Search
USPC ..... 472/128
See application file for complete search history.

(56) References Cited

U.S. PATENT DOCUMENTS

| | | | | | |
|---|---|---|---|---|---|
| 2,284,736 | A | | 6/1942 | Hetherington | |
| 2,480,989 | A | * | 9/1949 | Weaver | 239/513 |
| 3,664,586 | A | * | 5/1972 | Harris | B05B 3/06 239/233 |
| 5,194,048 | A | | 3/1993 | Briggs | |
| 5,232,160 | A | * | 8/1993 | Hendrickson et al. | 239/276 |
| 5,405,294 | A | | 4/1995 | Briggs | |
| 5,480,336 | A | | 1/1996 | Blanchard | |
| 5,649,867 | A | | 7/1997 | Briggs | |
| 5,662,525 | A | | 9/1997 | Briggs | |
| 5,741,189 | A | | 4/1998 | Briggs | |
| 5,820,471 | A | * | 10/1998 | Briggs | A63B 9/00 472/117 |
| 5,820,472 | A | | 10/1998 | Briggs | |
| D406,871 | S | | 3/1999 | Briggs | |

* cited by examiner

*Primary Examiner* — Michael Dennis
(74) *Attorney, Agent, or Firm* — Richard D. Okimaw

(57) ABSTRACT

Disclosed is a deflector for a water dump apparatus positioned within a flow path of water discharged from a selectably dischargable container. The deflector comprises a deflector body having a top deflection surface thereon, a pivot mount for pivotally supporting the deflector body and an adjustor for selectably fixing the deflector plate at an orientation desired by a user. The deflector body may extend between first and second ends and be pivotally supported at the first end thereof. The deflector surface may be a planar concave or convex surface. The deflector body has an exterior edge which is substantially circular. The adjustor may comprise an actuator such as a hydraulic cylinder or a pin selectably engageable within one of a plurality of notches.

12 Claims, 13 Drawing Sheets

WATER AMUSEMENT DEVICE

CROSS REFERENCE TO RELATED APPLICATION

This application claims priority to U.S. Provisional Patent Application No. 61/272,611 filed Oct. 13, 2009 entitled WATER AMUSEMENT DEVICE.

BACKGROUND OF THE INVENTION

1. Field of Invention

The present invention relates to deflectors in general and in particular to an adjustable water deflector for a water amusement device.

2. Description of Related Art

Water amusement parks, which may also be known as splash pads, are a popular location for children and adults during hot times of the year. Such facilities typically include a variety of water features including horizontal, vertical and user directed water sprays, dump buckets, misters, and interactive and fixed waterflow features. Water amusement parks offer a place for people to cool off during hot weather and also provide entertainment for children who enjoy playing with the colorful structures and various water jets and streams.

In particular, dump buckets are known to be particularly enjoyable for many children. Dump buckets include a container pivotally mounted about a horizontal axis to a structure. A water supply is placed above or within the container to fill it at a predetermined rate. The weight of the container is distributed such that the container will remain upright until it contains a predetermined volume of water at which point it will tip about its axis spilling its contents.

Dump buckets are often supported above an unobstructed location within a water amusement park to discharge their contents directly onto the ground below. Such dump buckets are typically small due to the undesirability of dumping a large amount of water onto a small child. Large dump buckets have been utilized, however that dump onto a flat or corrugated angled surface. Such surfaces however must be sized and angled so that the water being dumped thereon is directed at the correct speed, volume and direction for the group of users for which it is designed. Accordingly, where some such large dump buckets may be designed for an older child age group, and therefore have large volumes of water flowing off the plate at high speed to provide these children with excitement, the same arrangement will not be suitable for younger children. In addition, current designs having a flat plate typically only produce a simple flow of water in a single direction, without any directional or pattern control.

SUMMARY OF THE INVENTION

According to a first embodiment of the present invention there is disclosed a deflector for a water dump apparatus positioned within a flow path of water discharged from a selectably dischargable container. The deflector comprises a deflector body having a top deflection surface thereon, a pivot mount for pivotally supporting the deflector body and an adjustor for selectably fixing the deflector plate at an orientation desired by a user.

The deflector body may extend between first and second ends and be pivotally supported at the first end thereof. The deflector surface may be a planar surface. The deflector surface may be concave. The deflector body has an exterior edge. The exterior edge may be substantially circular.

The adjustor may be operably engaged with the second end of the deflector body. The adjustor may be pivotally secured to the second end of the deflector. The adjustor may comprise an actuator. The actuator may comprise a hydraulic cylinder. The adjustor may comprise an extension selectably engageable within one of a plurality of receivers. The extension may comprise a pin while the plurality of receivers may comprise a plurality of notches.

According to a further embodiment of the present invention there is disclosed a water amusement apparatus comprising a selectably fillable container pivotally supported by a structure and a deflector positioned within a flow path of water discharged from the container. The deflector comprises a deflector body having a top deflection surface, a pivot mount for pivotally supporting the deflector body and an adjustor for selectably fixing the deflector plate at an orientation desired by a user.

The deflector body may extend between first and second ends. The pivot mount may pivotally support the first end of the deflector body. The apparatus may further comprise a water outlet positioned to fill the container.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
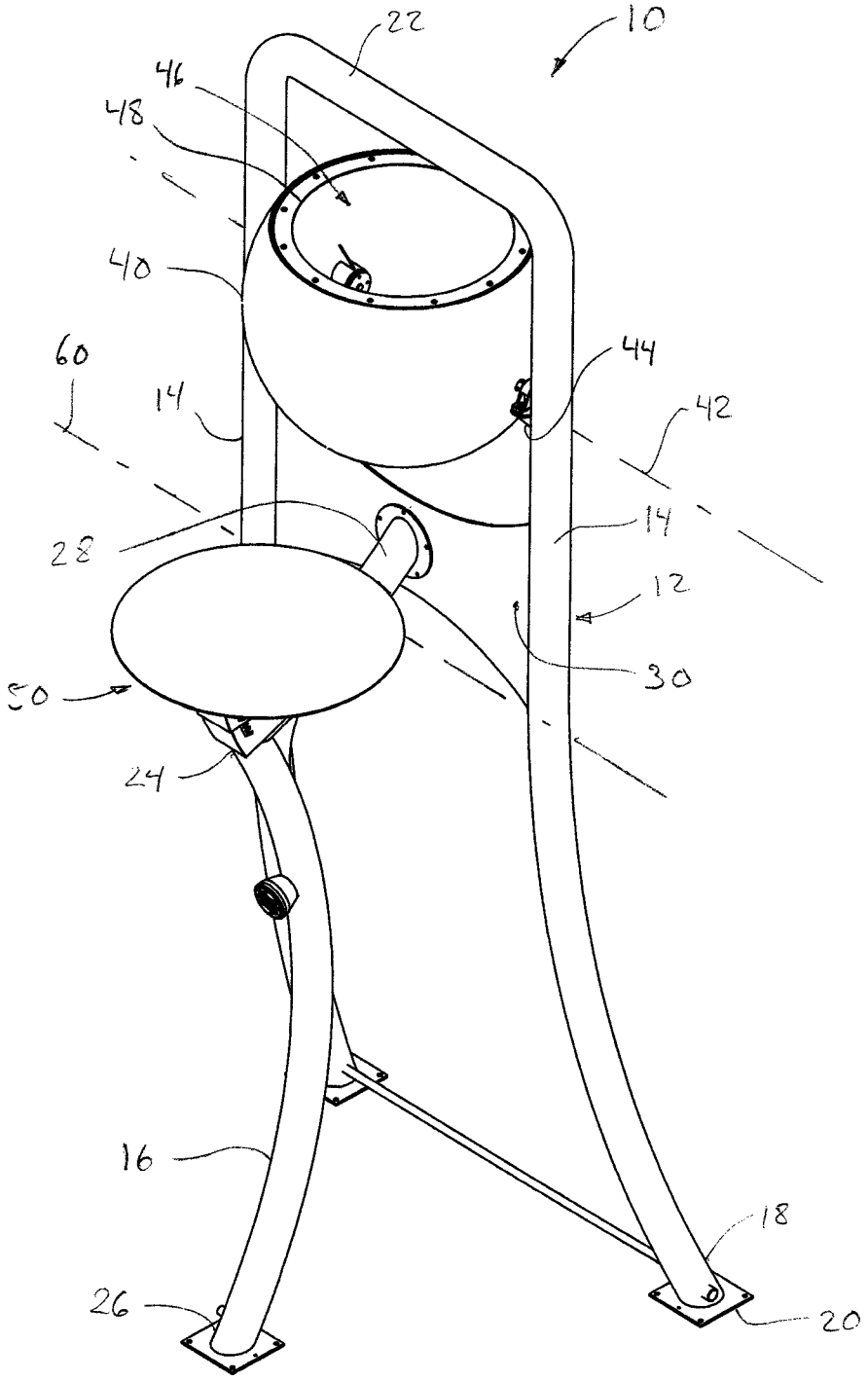
FIG. 1 is a perspective view of a water amusement dump bucked according to a first embodiment of the present invention.

Referring to FIG. 1, a dump bucket according to a first embodiment of the invention is shown generally at 10. The dump bucket comprises a frame 12 supporting a rotatable container 40 and a deflector plate 50. The frame 12 supports the rotatable container 40 so as to be freely rotatable about a horizontal axis 42. The frame 12 further supports the deflector plate 50 at a position so as to be within the flow path of water discharged from the rotatable container 40 as will be further described below.

Figure 2:
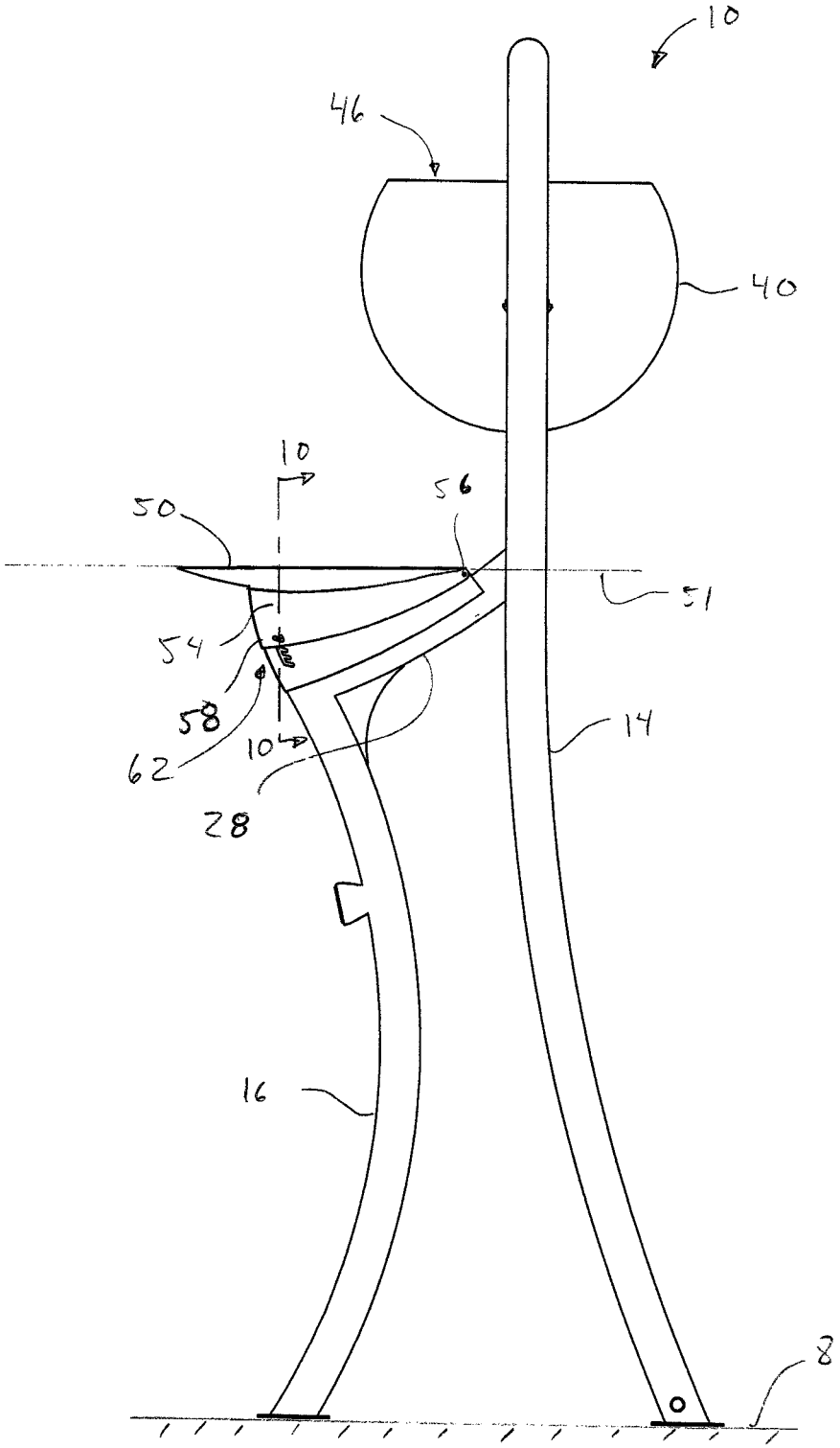
FIG. 2 is a side view of the dump bucket of FIG. 1 in a first or filling position.
Figure 3:
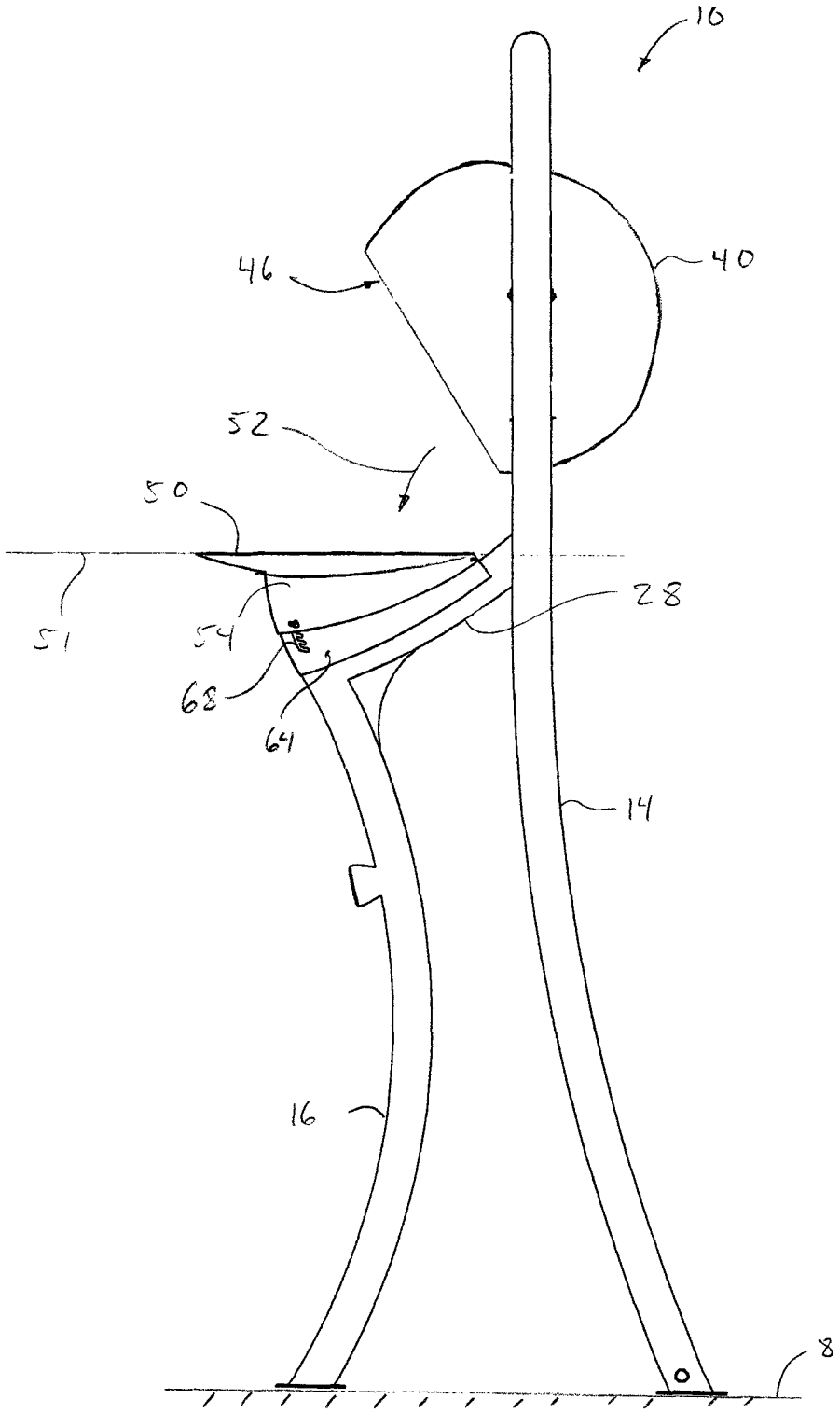
FIG. 3 is a side elevational view of the dump bucket of FIG. 1 with the container in a second or discharging position.

The frame 12 comprises a pair of spaced apart rear uprights 14 and a front upright 16. The rear uprights 14 extend from bottom ends 18 having attachment plates 20 secured thereto to a top cross bracing member 22. The attachment plates 20 may be bolted or otherwise secured to a ground surface 8 as illustrated in FIGS. 2 and 3. The front upright extends between top and bottom ends, 24 and 26, respectively wherein the bottom end 26 includes an attachment plate 20. The rear uprights 14 have a back plate 30 extending therebetween which supports a center support member 28 in conjunction with the top end 24 of the front upright 16.

As illustrated the front and rear uprights may be circular tubing, although it will be appreciated that other cross-sectional member may be utilized as well including solid or hollow structural members such as, by way of non-limiting example, square, rectangular or oval as well as other types of known structural member such as I-shaped beams or T-shaped beams. It will also be appreciated that although a tube space frame is illustrated in the attached figures and described above, other suitable support structures may be utilized as well.

Turning to FIGS. 2 and 3, the container 40 comprises a fluid holding vessel having an opening 46 in a top portion 48 thereof. The container may be of any shape desired, such as, by way of non-limiting example, spherical, cylindrical, conical or any other regular or non-regular shape. The container 40 is rotatably supported by the frame about axis 42 by a pair of bearings 44 disposed on the sides of the container. The bearings 44 may include rotation limit stops to maintain the rotation of the container within a predefined angle of rotation between first and second positions. The limit stops may be integral with or separate from the bearings 44. As illustrated in FIG. 2, a first position of the container 40 is illustrated. As shown, the opening 46 is oriented upwards so as to permit the container 40 to be filled by a fill hose or nozzle (not shown) located above or within the container opening 46 as are conventionally known in the art. This position may also be referred to as a fill position. As shown in FIG. 3, a second or discharge position is illustrated. In the second position, the container 40 is rotated such that the opening 46 is oriented towards the deflector plate 50. In the second position, stops either within the bearings 44 or through other means such as a container bumper are provided to prevent the container 40 from rotating past the second position. In the second position, the water contained within the container 40 is discharged out of the container 40 and onto the deflector plate 50 along a path generally indicated at 52.

The container 40 has a center of mass (not shown) which is located below axis 42 when the container is oriented in the first position. Accordingly, when the container 40 does not include any water therein, the container will be naturally weighted to return to the first position due to the rotation of its center of mass about the axis 42. Thereafter the container may be filled by the nozzle. As the container 40 is filled with water, the center of mass of the container and water will rise as the water level exceeds the axis 42. Once the center of mass is above the axis 42, the balance of the container will become unstable and will thereafter tip and rotate to the second position at which time the water in the container will be discharged onto the deflector plate 50.

As shown in FIGS. 2 and 3, the deflector plate 50 defines a deflector plane 51 and is supported from a deflector support body 54 extending between first and second ends, 56 and 58, respectively. The first end 56 is pivotally supported by the center support member 28 about deflector plate axis 60 as shown in FIG. 1 by any known means such as a pivot pin 61. The second end 58 of the deflector support body 54 includes an indexing means 62 to selectably engage upon the center support member 28 at one of a plurality of height so as to permit the user to adjust the height of the second end of the deflector support body 54 and therefore to also adjust the angle of the deflector plate 50.

Figure 4:
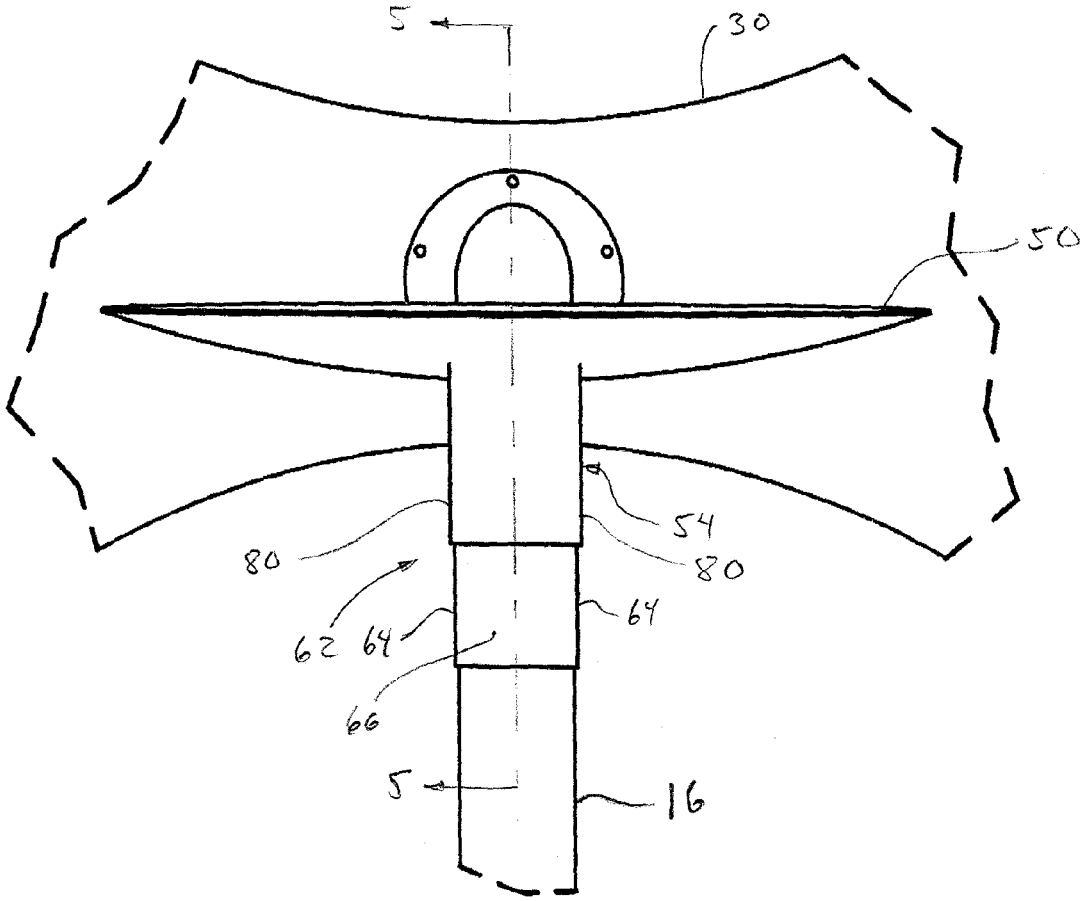
FIG. 4 is a detailed front view of the deflector plate and indexing means of the dump bucket of FIG. 1.
Figure 5:
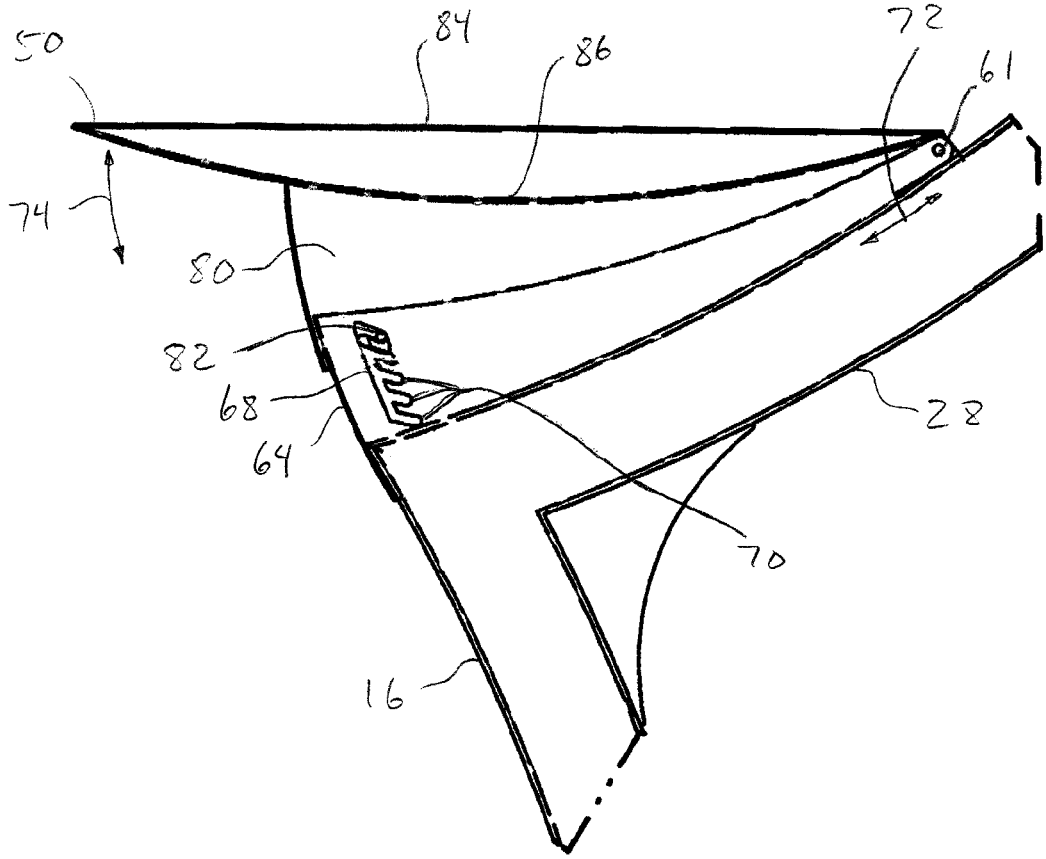
FIG. 5 is a cross sectional view of the deflector plate and indexing means taken along the line 5-5 in FIG. 4.

Turning to FIGS. 4 and 5 a detailed front view of the dump bucket 10 around and including the deflector plate 50 and indexing means 62 is illustrated. As illustrated the indexing means may comprise a pair of spaced apart side walls 64 which may optionally form a box or rectangular section 66. The side walls 64 may be supported on or extend vertically from the edges of the center support member 28. As shown in FIG. 5, the side walls include a slot 68 therethrough having a plurality of angular notches 70. Each of the notches 70 are positioned to correspond to one of a plurality of angular orientations of the deflector plate. The deflector support body 54 comprises a pair of spaced apart support plates 80.

Figure 10:
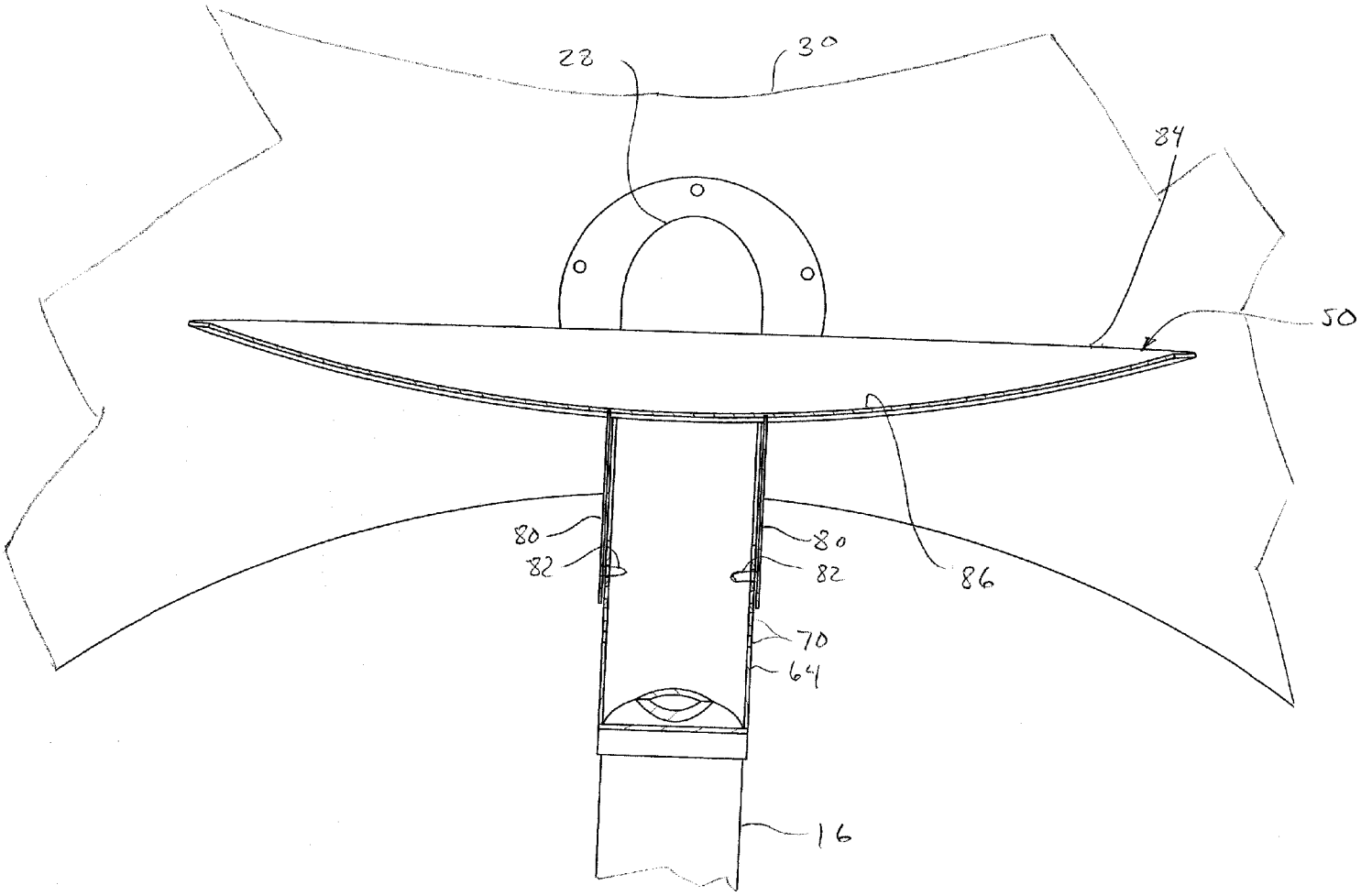
FIG. 10 is a cross sectional view of the deflector plate and indexing means taken along the line 10-10 in FIG. 9.

As illustrated in FIG. 10, the support plates 80 are located outside of the side walls 64. It will also be appreciated, that the support plate 80 may be located within the side walls 64 such that the pins 82 extend outwardly. The support plates 80 include a pin 82 perpendicularly therefrom. The pin 82 may comprise a single continuous pin spanning the support plates 80 or may optionally comprise a pair of axially aligned pins extending inwardly from each support plate 80. Each pin 82 is sized and located to be received within the slot 68 and to selectably engage or disengage with one of the plurality of notches 70. The pivot pin 61 may located within a slot (not shown) or other means to permit the pivot pin 61 to have a degree of freedom along the center support member 28 as generally indicated at 72. This will permit the support plates 80 and deflector plate 50 to be moved along the center support member 28 in the direction 72 so as to engage and disengage the pins 82 from the notches 70. The pins 82 may also be disengaged from the notches 70 manually, pneumatically, hydraulically, or mechanically such as through the use of gears or the like by way of non-limiting example. As described below, the deflector plate 50 may also be adjusted using a self-supporting mechanism that does not require pins. Once the pins 82 have been disengaged from the notches 70, the support plates 80 and the deflector plate 50 may then be rotated about the deflector plate axis 60 in the direction generally indicated at 74 so as to reorient the deflector plate as desired by a user.

Figure 6:
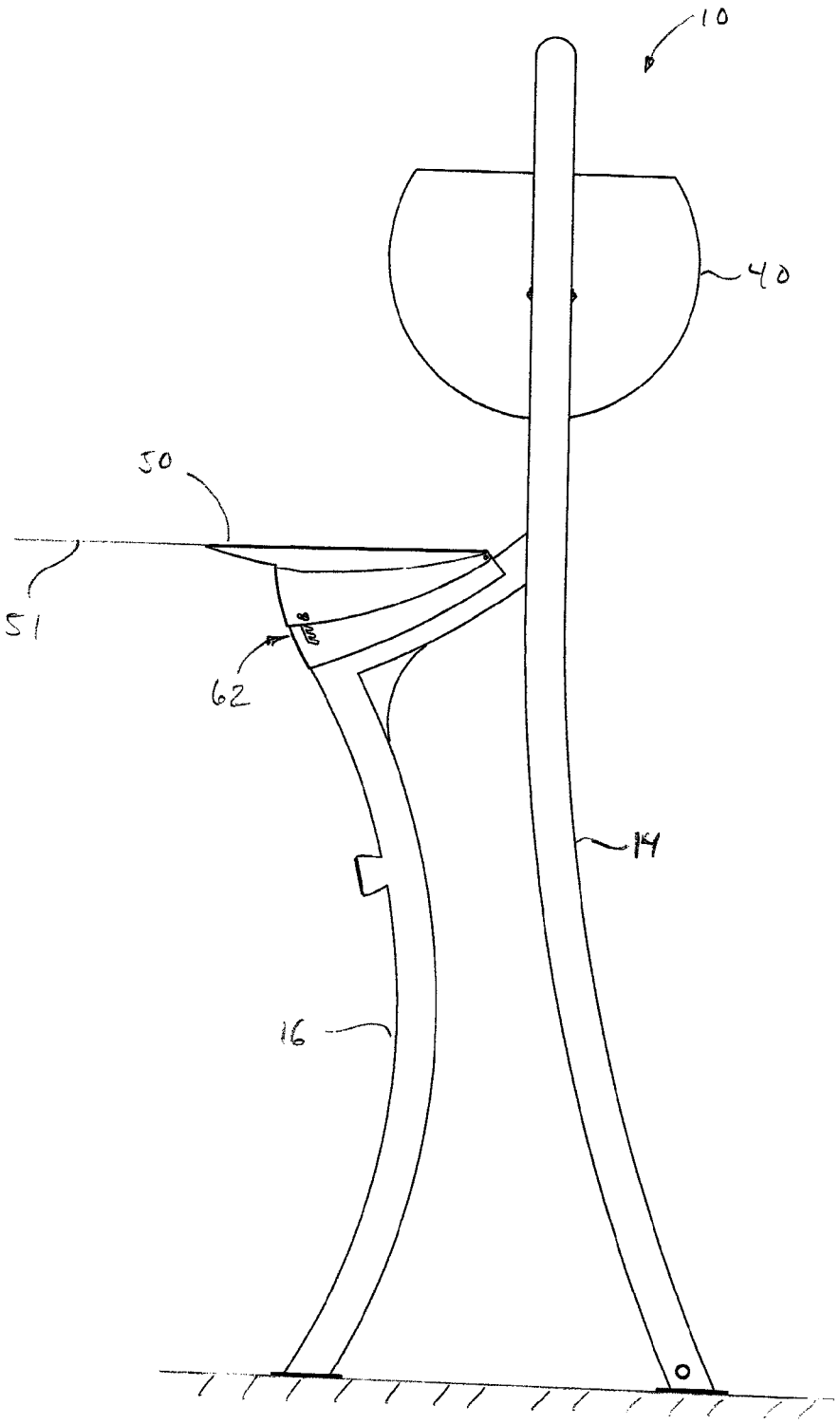
FIG. 6 is a side elevational view of the dump bucket of FIG. 1 with the deflector plate at a first position.
Figure 7:
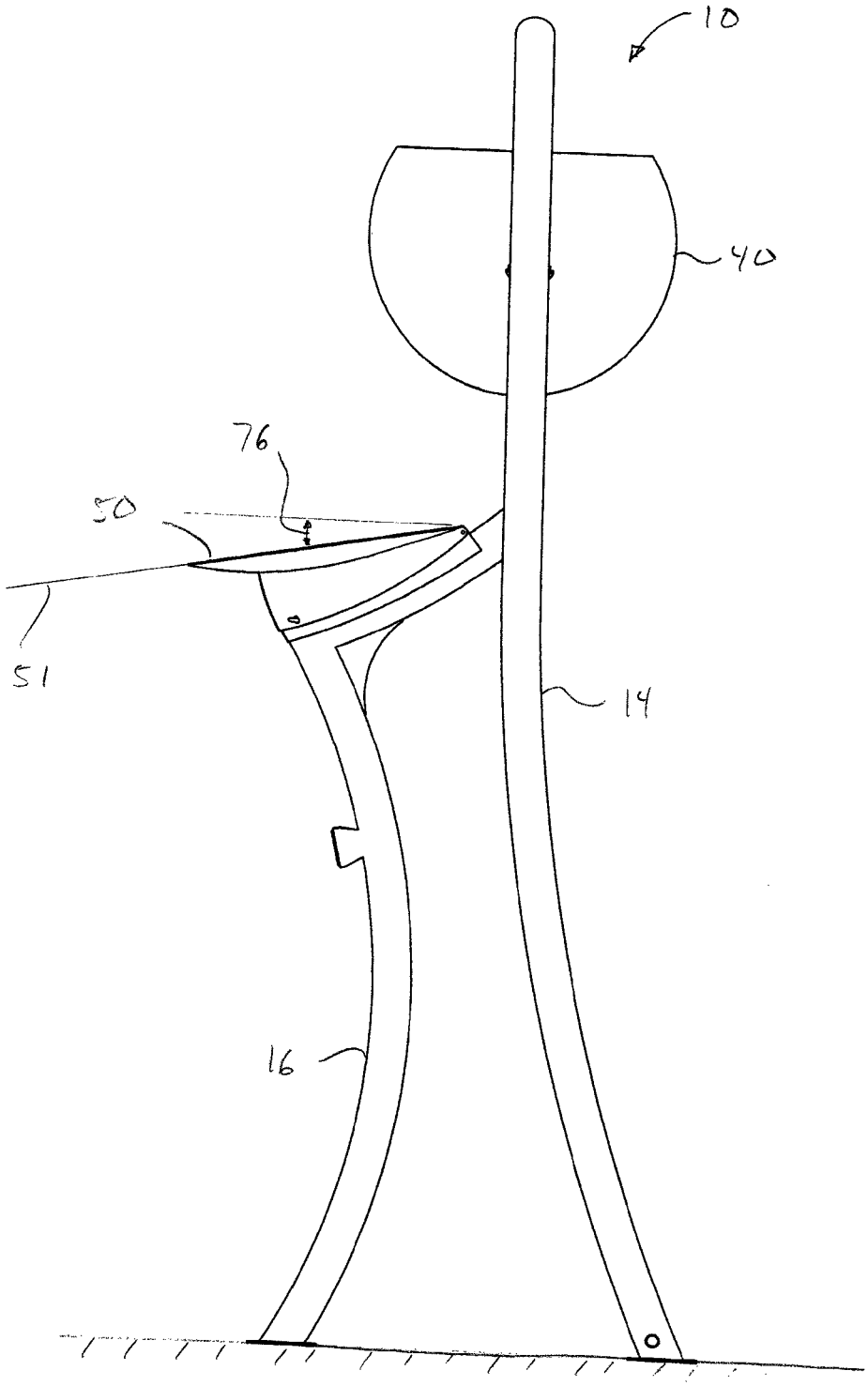
FIG. 7 is a side elevational view of the dump bucket of FIG. 1 with the deflector plate at a second position.

By engaging the pins 82 in a higher notch 70, the angular orientation of the deflector plate 50 may be reduced as illustrated in FIG. 6 wherein the deflector plane 51 is substantially horizontal. The pins 82 may also be engaged within lower notches 70 such that the angular orientation of the deflector plate 50 is increased as illustrated in FIG. 7 wherein the deflector plane is angularly oriented below horizontal by a deflector angle generally indicated at 76. The dump bucket 10 as described above may have a range of possible deflector angles of between 60 and 90 degrees although it will be appreciated that other angles may be utilized as well.

In a higher position, as illustrated in FIG. 6, the deflector plate 50 will cause a greater reduction in the speed of the water discharged from the container 40. The water so discharged will also be arranged more radially even around the deflector plate. Such a position will be suitable for smaller children and persons who enjoy more gentle water flows. When the deflector plate 50 is moved to a more angular position as shown in FIG. 7, the water will be discharged more towards the front of the deflector plate and will also be reduced less in speed. Consequently, the discharge of water will be more concentrated having a greater impact on persons so situated. Such positions will be suitable for older children and persons desiring a greater impact and pressure from the water.

Figure 8:
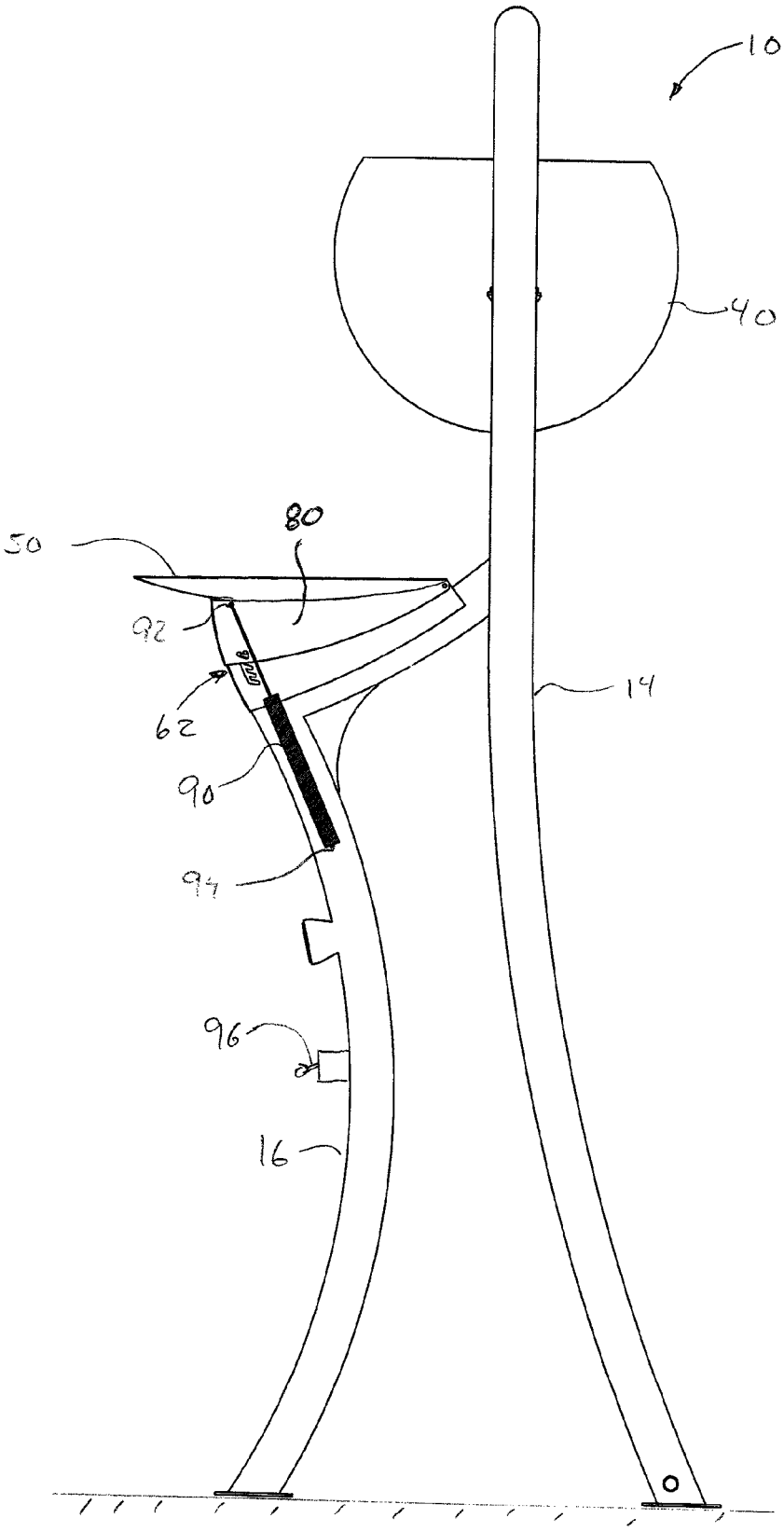
FIG. 8 is a side elevational view of the dump bucket of FIG. 1 having an actuating cylinder according to a further embodiment.

The deflector plate 50 may have an actuator for moving the deflector plate between specific notches 70. As illustrated in FIG. 8, the actuator may comprise a hydraulic or pneumatic cylinder 90 or other similar suitable linear actuator. The hydraulic cylinder may extend between a bottom connection point 94 of the front upright 16 and a top connection point 92 of the support plates proximate to the second end 58 of the support body 54. Optionally, the support body 54 may be pivotally supported at the front wherein the indexing means 62 is located proximate to the rear of the support body. In such an arrangement, the hydraulic cylinder may be similarly attached to the rear of the support body 54. The hydraulic cylinder 90 may optionally connect to an extension extending from the support body opposite the indexing means such that the indexing means 62 and hydraulic cylinder 90 are connected to opposed ends of the support body with the pivot pin 61 located therebetween. In such an arrangement, the hydraulic cylinder will operate in tension to maintain the deflector plate at a desired height. In a further embodiment, the notches 70 and pins 82 may be omitted and the deflector plate maintained at a desired orientation by the actuator, such as a hydraulic or pneumatic cylinder 90 alone. The hydraulic cylinder 90 can either move the plate through a series of detents or be adjusted infinitely to the operator's desired angle.

The hydraulic cylinder 90 may utilized water as its hydraulic fluid in which case, the water may be provided from the water supply for the remainder of the facility or may be a separate supply. Optionally, the hydraulic fluid may be a specific hydraulic fluid such as oil or the like. Control of the hydraulic cylinder 90 may be provided either directly by a user remote or proximate to the dump bucket 10 through a hydraulic valve or the like. By way of non-limiting example, a hydraulic valve 96 may be located on or proximate to the frame 12 of the dumping bucket to permit a user to adjust the orientation of the deflector bucket. Optionally, the hydraulic valve 96 may be located remotely to permit a facility manager to set the orientation of the deflector plate at a desired angle for a given group of users. The hydraulic cylinder may also be controlled remotely by a computer processing circuit, such as a PLC or the like to be either fixed at a specified angle for a given time period or modulated over time according to a fixed or random schedule.

Figure 9:
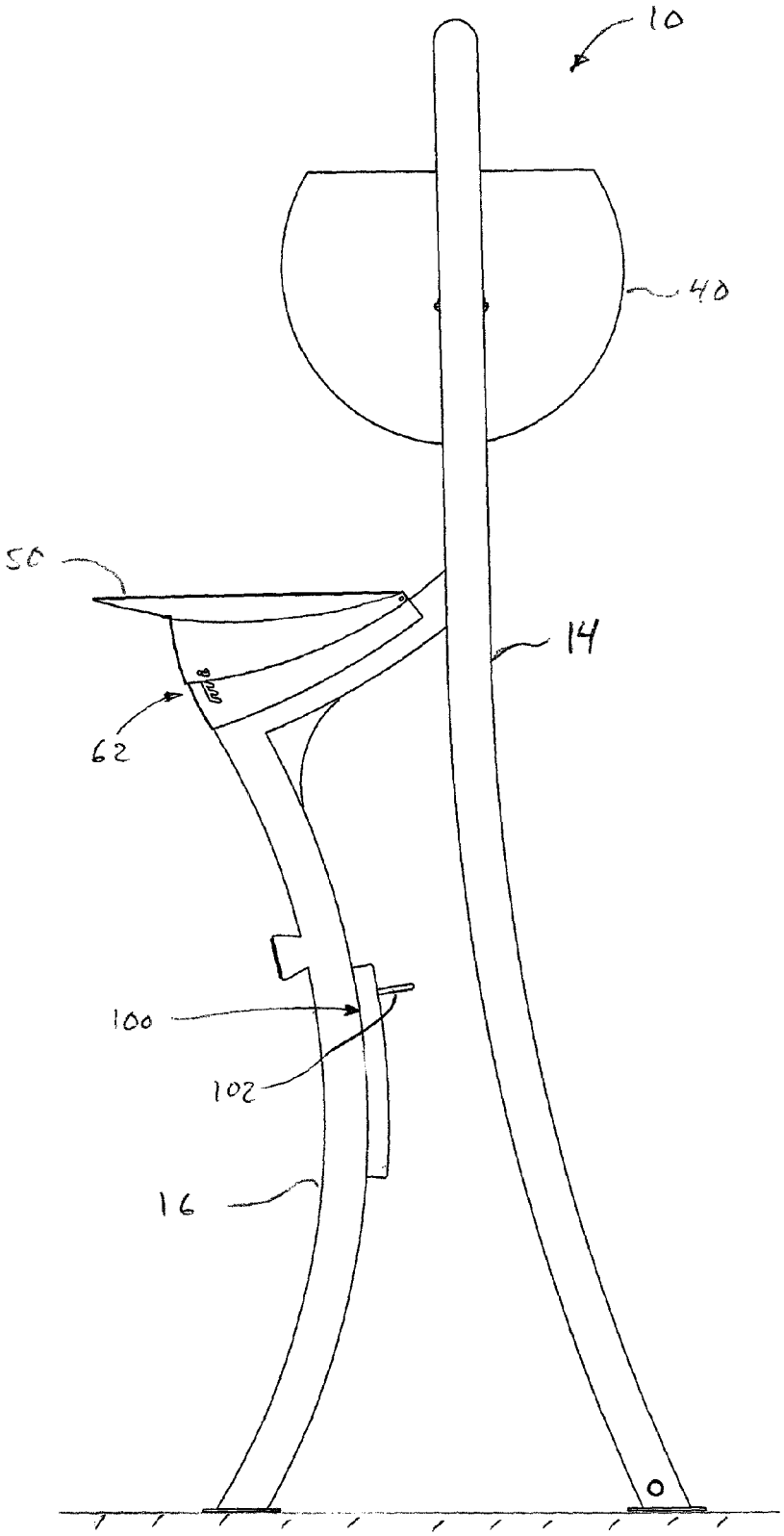
FIG. 9 is a side elevational view of the dump bucket of FIG. 1 having slide actuator according to a further embodiment.

Turning now to FIG. 9, an alternative embodiment is illustrated having a manual adjustor 100. The manual adjustor 100 may comprise a handle 102 longitudinally movable along the one of the uprights of the frame 12. The manual adjustor 100 may interconnect with a member either internal or external to the upright to engage with and transmit motion of the handle 102 to the deflector plate to permit the deflector plate orientation to be adjusted with movement of the handle. In other embodiments, the deflector plate may include a rotary motor or mechanical crank about the pivot pin 61 or any other suitable means of rotationally moving the deflector plate about the pivot pin. It will be appreciated, that although a hydraulic actuator and manual adjusting handle are described and illustrated, that other manual or powered adjusting devices may be utilized to adjust the angular orientation of the deflector plate 50, such as by way of non-limiting example, gears, motors, levers, screw jacks, pulleys or cams.

The deflector plate comprises plate having an exterior edge 84 and a deflector surface 86. As illustrated in FIG. 5, the deflector plate may have a concave profile although it will be appreciated other profiles may also be utilized as well, such as convex or planar or may optionally include surface treatments such as corrugation, flow diverters, perforations or stippling may also be used to create texture. The surface treatments may also be adjusted to create a desired flow effect according to known methods. A dished or concave deflector creates a flow that fans out in multitude of directions. The spherical plate deflects the water in an arc formation creating a pleasing aesthetic effect. The spherical plate is adjustable so the height and length of the arc can be manipulated by the operator and/or user. The outline of the deflector plate 50, as defined by the exterior edge 84 may be substantially circular, as illustrated in FIG. 1, although it will be appreciated that other outline shapes may be utilized as well, such as, by way of non-limiting example, oval, rectangular, square, triangular, star-shaped, polygonal, or irregular as desired by a user. The circular shape shown and described above, has been found to be useful at creating a radially even distribution of water flowing off the deflector plate. Other shapes may similarly be selected based upon the desired preference for water distribution around the dump bucket.

The back plate 30 may have a bow-tie shape or any shape as desired. In particular the back plate 30 may be sized and located such that water splashing off the rear edge of the deflector plate 50 will impact the back plate 30 such that the back plate 30 prevents excessive water from passing to the rear of the dump bucket 10.

Figure 11:
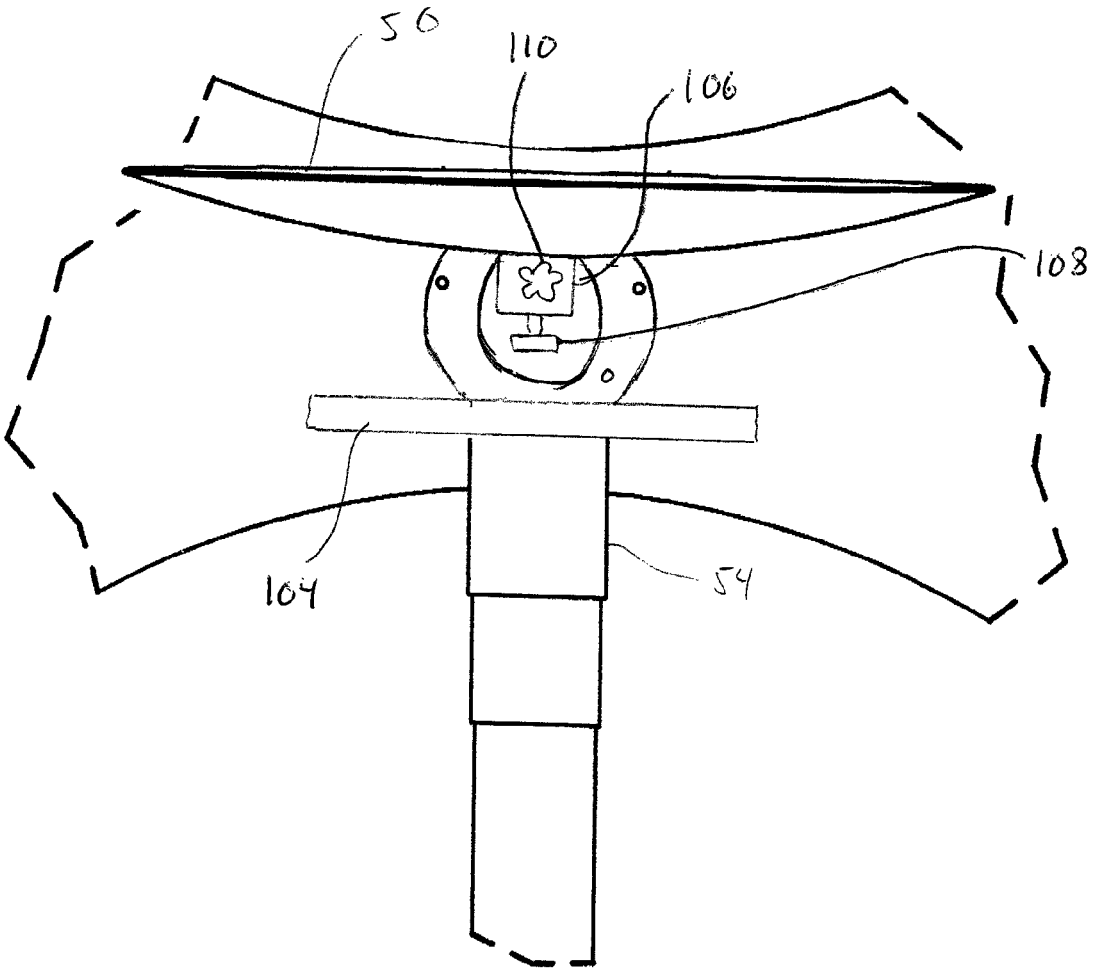
FIG. 11 is a detailed view of a sliding deflector plate according to a further embodiment of the present invention

Turning now to FIG. 11, an alternative embodiment of the dump bucket is illustrated having a lateral sliding track 104. The track is mounted perpendicularly to the support body 54 and provides an elongate path of travel. The deflector plate 50 includes a carriage 106 secured to the bottom thereof having a track follower 108 and a hand crank 110 or other suitable tightening mechanism. The track follower 108 may be slidably received within the track 104 and the deflector plate 50 positioned to a desired location. Thereafter the hand crank 110 may be tightened to secure the follower 108 within the track according to know methods. In this way the deflector plate 50 may be adjusted laterally under the container 40. It will be appreciated that the track 104 may also be oriented such that the deflector plate 50 is moveable in along a path perpendicular to that shown in FIG. 11 such that the deflector plate is moveable towards and away from the container 40 as well. Similarly, it also be appreciated that the indexing means 62 illustrated above may also be oriented perpendicularly to that shown to permit the deflector plate 50 towards one side of the dump bucket 10 or the other.

Figure 12:
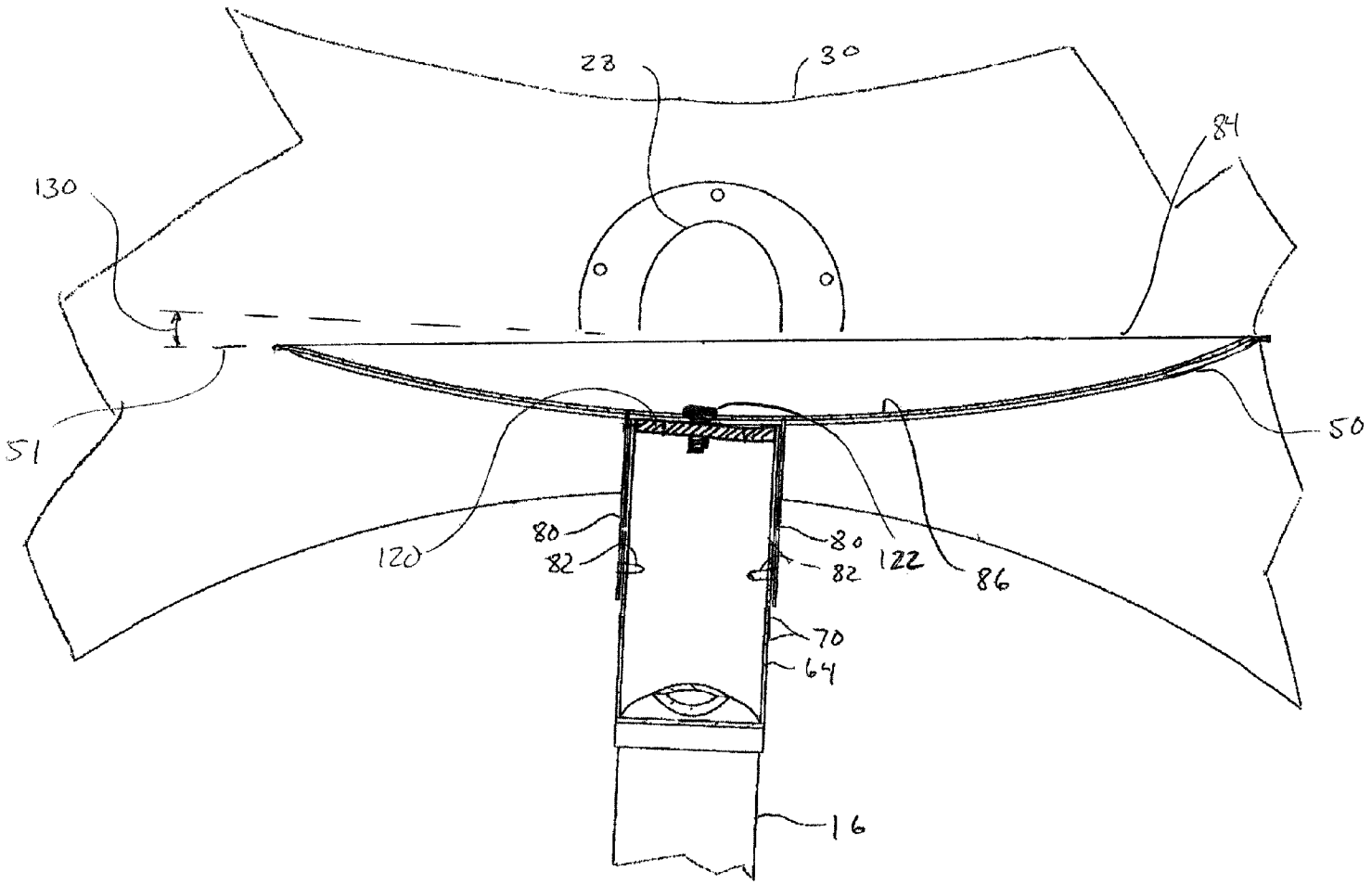
FIG. 12 is a cross sectional view of the deflector plate having an optional lateral adjusting means taken along the line 10-10 in FIG. 9.
Figure 13:
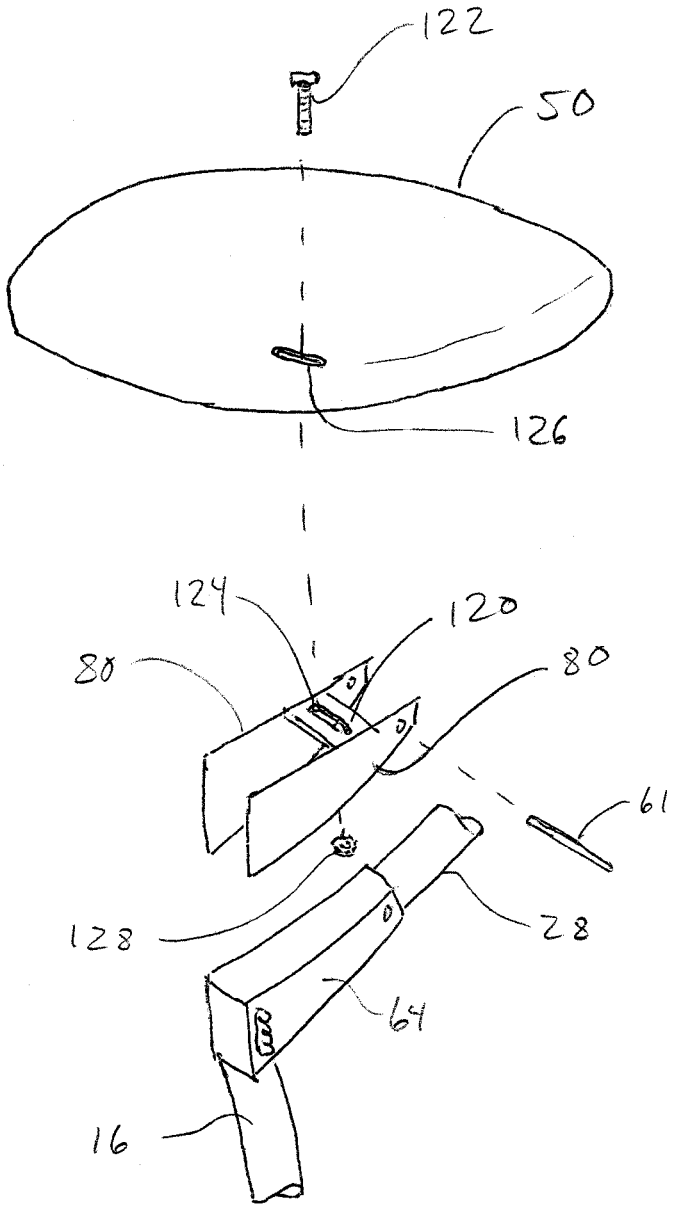
FIG. 13 is a detailed exploded view of the lateral adjusting means of FIG. 12.

Turning now to FIGS. 12 and 13, a deflector plate 50 having lateral angular adjustment according to a further embodiment is illustrated. The support plates 80 may include a lateral adjusting plate 120 extending therebetween adjacent to the bottom of the deflector plate 50. The deflector plate 50 includes an adjusting aperture 126 through a bottom thereof and may be secured to and supported by the lateral adjusting plate 120 by a bolt 122 or other suitable fastener passing through the adjusting aperture 126 and lateral adjusting plate. The bolt 122 includes a nut 128 which may be utilized to secure the bolt and deflector plate to the lateral adjusting plate 120. The lateral adjusting plate 120 includes an adjusting slot 124 extending perpendicularly to the support plates 80 such that the deflector plate may be positioned to a location offset from the center of the lateral adjusting plate. Optionally, the adjusting aperture 126 may comprise a slot as illustrated in FIG. 13 such that the deflector plate may be angularly oriented relative to the horizontal by an angle generally indicated at 130. In operation, a user may loosen the bolt 122 and angularly or laterally orient the deflector plate 50 to a preferred angle or position. Thereafter the bolt 122 may be tightened to retain the deflector plate at the desired orientation or lateral position. It will be appreciated that other fastening means may be utilized in place of the bolt 122 and nut 128, such as, by way of non-limiting example, a knob having a threaded shaft, clamp or any other device for frictionally securing the deflector plate to the lateral adjusting plate.

While specific embodiments of the invention have been described and illustrated, such embodiments should be considered illustrative of the invention only and not as limiting the invention as construed in accordance with the accompanying claims.

What is claimed is:

1. A water amusement apparatus comprising:

a selectably fillable bucket having an open top pivotable between a filling orientation with said open top oriented upwards and an emptying orientation with said open top positioned to dispense a fluid contained therein supported by a structure; and a deflector positioned below said bucket within a flow path of water discharged from said bucket, said deflector comprising:

a deflector body having a concave top deflection surface;

a pivot mount for pivotally supporting said deflector body about a horizontal axis; and a linear adjustor for selectably fixing said deflector plate at an orientation desired by a user, said linear adjustor secured to said deflector plate at a position distal from said pivot mount and extending to said structure wherein said linear adjustor has an adjustable length to pivot said deflector plate.

2. The water amusement apparatus of claim 1 wherein said deflector body extends between first and second ends.

3. The water amusement apparatus of claim 2 wherein said pivot mount pivotally supports said first end of said deflector body.

4. The water amusement apparatus of claim 1 wherein said apparatus further comprises a water outlet positioned to fill said bucket.

5. The water amusement apparatus of claim 1 wherein said deflector body has an exterior edge.

6. The water amusement apparatus of claim 5 wherein said exterior edge is substantially circular.

7. The water amusement apparatus of claim 2 wherein said adjustor is operably engaged with said second end of said deflector body.

8. The water amusement apparatus of claim 7 wherein said adjustor is pivotally secured to said second end of said deflector.

9. The water amusement apparatus of claim 1 wherein said adjustor comprises an actuator.

10. The water amusement apparatus of claim 9 wherein said actuator comprises a hydraulic cylinder.

11. The water amusement apparatus of claim 9 wherein said adjustor comprises an extension selectably engageable within one of a plurality of receivers.

12. The water amusement apparatus of claim 11 wherein said extension comprises a pin while said plurality of receivers comprises a plurality of notches.

* * * * *